US005230176A

United States Patent [19]

Schomaker

[11] Patent Number: 5,230,176

[45] Date of Patent: Jul. 27, 1993

[54] TEMPORARY SIGN

[76] Inventor: Michael B. Schomaker, 1763 Gabbro Trail, Eagan, Minn. 55122

[21] Appl. No.: 875,046

[22] Filed: Apr. 28, 1992

[51] Int. Cl.[5] ..... G09F 15/00

[52] U.S. Cl. ..... 40/607; 248/218.4

[58] Field of Search ..... 248/214, 218.4, 300; 40/606, 607; 24/303

[56] References Cited

U.S. PATENT DOCUMENTS

| | | | |
|---|---|---|---|
| 1,068,391 | 7/1913 | Jensen | 248/214 |
| 1,238,976 | 9/1917 | Zika | 40/607 |
| 2,383,881 | 8/1945 | Murphy | 40/607 |
| 3,129,477 | 4/1964 | Mizuno | 24/303 |
| 4,548,377 | 10/1985 | Huel | 40/607 X |
| 4,706,400 | 11/1987 | Howard et al. | 40/607 X |
| 4,854,063 | 8/1989 | Brunell | 40/607 |
| 4,910,901 | 3/1990 | Boyar | 40/607 |

*Primary Examiner*—Kenneth J. Dorner
*Assistant Examiner*—J. Bonifanti
*Attorney, Agent, or Firm*—Donald A. Jacobson

[57] ABSTRACT

Temporary real estate signs are attached to a post and extending arm rather than suspended beneath the arm. The signs are attached to a supporting body having a U-shaped cross-section. The bodies are sized to fit around the arm and post respectively. Flexible members attached in one end to the body are led around the arm or post and secured temporarily to the body on the opposite side to secure the bodies in place. A number of temporary attachment means are shown. A version having the body grip the arm or post by extensions is also provided. In a second version extensions having a rectangular opening extending from the bodies are oriented to fit over the top of the post are provided to prevent the bodies from sliding with respect to the arm or post.

5 Claims, 2 Drawing Sheets

TEMPORARY SIGN

FIELD OF THE INVENTION

This invention relates to temporary signs used in conjunction with a permanent brokerage sign to indicate the individual realtor and sales status of real estate property to the public.

BACKGROUND OF THE INVENTION

A large number of realtors in the United States use a post with an arm which extends outward perpendicularly from the upper portion of the post to display sales information relating to property being sold at that site. The extension arm is used to support a first sign suspended beneath the arm. This first sign typically gives the name and address of the listing broker. This first sign has a second sign suspended from it to provide the name and telephone number of the individual realtor of that brokerage responsible for the property, and a third sign is often suspended from the second sign to provide the sales status of the property. The second sign is usually suspended from the first sign and the third sign from the second sign by a pair of rings which engage holes near the adjacent edges of the respective signs and support the lower sign. This approach permits displaying all of the necessary sales information in a format which readily permits changing the individual second and third sign. Unfortunately the rings will often pull through the edge of the sign adjacent to the holes and drop one end of the supported sign. This is unsightly, detracts from the selling message, and if snow is present can even result in the second and third signs being obscured. This also requires that a new sign be substituted for the damaged one because a field repair is impractical. A periodic inspection is also necessary if one is to be sure that such a failure has not occurred. This is inconvenient since such signs are usually scattered over a large geographic area.

SUMMARY OF THE INVENTION

The instant invention overcomes the problems of the current temporary real estate signs by attaching the second and third signs to the arm and post respectively. U-shaped bodies are used to attach both signs. The second sign is perpendicularly attached to one of the U-shaped bodies which is sized to fit over the upper portion of the extension arm. The second sign is mounted above the support arm, which has a square cross-section, using the U-shaped body which is sized to fit around and over a portion of the upper and side surfaces of the arm. The sign is attached such as to extend above the arm when the body is attached to the arm. The third sign is perpendicularly attached to the second U-shaped body which is sized to fit around the post. The third sign is similarly mounted along the outside of the first U-shaped body perpendicular to its length. This U-shaped body is attached such that the third sign will extend outward from the post in a direction opposite to the arm.

This method of attaching these two signs avoids the failure mode of the previous temporary signs since the attachment rings are no longer used. A further advantage is the fact that the second and third signs are now supported higher off the ground which minimizes the problem of snow or any other obstruction covering the signs.

In a first embodiment the supporting U-shaped bodies are held in place against the arm and post respectively by two flexible members which extend around them from one side of the body to the other being secured on the opposite sides to hold the body in place. The flexible members have attachment means on one end for temporarily attaching that end to the side of the U-shaped body to permit installing and removing the sign.

The body supporting the third sign also has a cap closure across the end of the U-shaped opening which extends over the top of the post to insure that the body will not slide down the post under the effect of gravity.

In a second embodiment a first extension from the first U-shaped body has a rectangular shaped opening which extends along the plane of the spine of the body. This opening is sized to fit over the top of the supporting post in the plane of the upper side of the arm when the body is in place. This first extension is placed over the top of the post as the first U-shaped body is mounted on the top of the arm and prevents the body from sliding horizontally with respect to the post. Only a single flexible member is used here which is then secured around the sign under the arm and between the opposite sides to hold the body in place.

In this second embodiment a second extension from the second U-shaped body extends perpendicular to the post sides when the body is in place against the post, such that the second extension also lies in the plane of the post top. This second extension also has a rectangular shaped opening sized to fit over the top of the supporting post which is placed over the top of the post when the supporting body is mounted against the side of the post. This second extension prevents the second U-shaped body from sliding downward under the effect of gravity. A single flexible member is also used here to secure the lower portion of the second U-shaped body against the post.

There are a number of attachment means shown to temporarily secure one end of flexible members to permit installing or removing these temporary signs. The flexible attachment means are eliminated in one version and the U-shaped bodies shaped to have inwardly directed projections, which are opposite the spine of the U-shape, sized to grip the enclosed respective arm or post in lieu of flexible members.

DETAILED DESCRIPTION OF THE DRAWINGS

FIG. 1 an isometric view of a post and arm showing a permanently mounted sign beneath the arm in dashed outline, and showing the first embodiments of the first and second U-shaped bodies used in supporting the first and second signs o arm and post respectively.

FIG. 2 a cross-section taken along 2—2 of FIG. 1 showing a first flexible member attachment means.

FIG. 3 cross-section taken along 2—2 of FIG. 1 showing a second flexible member attachment means.

FIG. 4 cross-section taken along 2—2 of FIG. 1 showing a third flexible member attachment means.

FIG. 5 cross-section taken along 2—2 of FIG. 1 showing the cross-section of the U-shaped body as the attachment means.

DETAILED DESCRIPTION OF THE PREFERRED EMBODIMENTS

Figure 1:
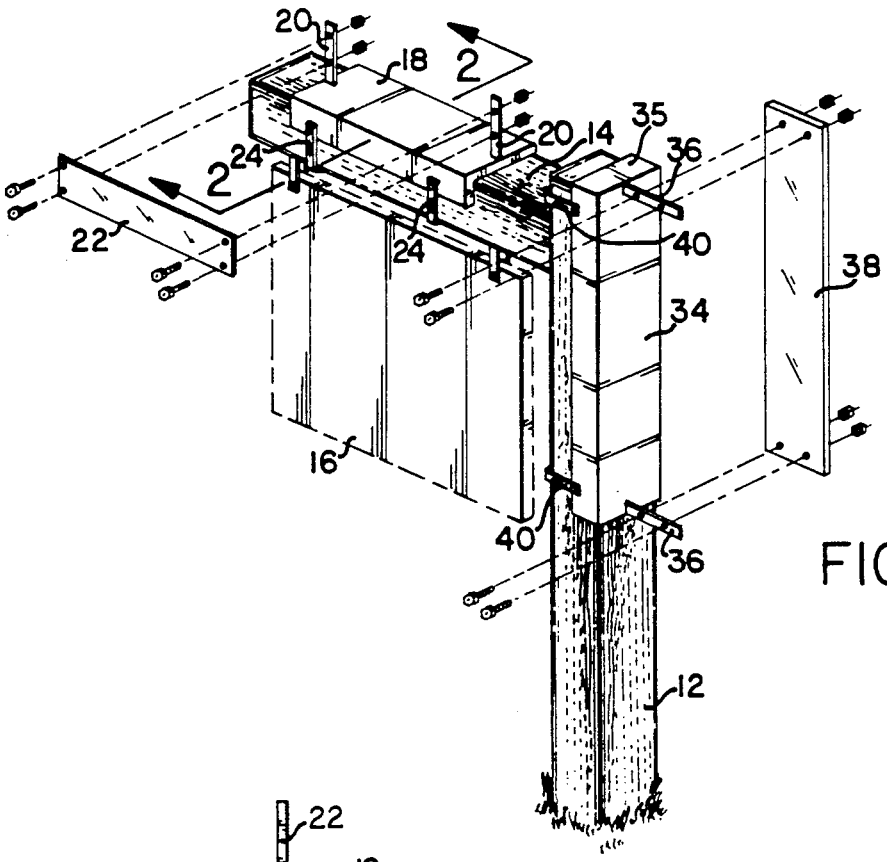

As shown in FIG. 1 post 12, supported in the ground in a vertical orientation, has an arm 14 attached to the post extending outward horizontally. A permanently mounted first sign 16, shown in dashed outline, is secured underneath arm 14 using brackets. First sign 16 is not part of the invention but is included to show the relationship between this sign and the mounting of the temporary signs which are this invention.

In a first embodiment of the invention a first U-shaped body 18 is positioned over arm 14. First U-shaped body 18 is formed of rigid material with a U-shaped cross-section having a central spine at right angles to two opposing limbs. The spine is sized to extend partially across the top surface of arm 14 with the limbs extending partially down the side surfaces of the arm. Brackets 20 are mounted on the outside of the spine of first U-shaped body 18. Brackets 20 hold second sign 22 perpendicular to the outer surface of the spine of first U-shaped body 18 by bolts extending through aligned holes through the brackets and the second sign which are secured by matching nuts.

Figure 2:
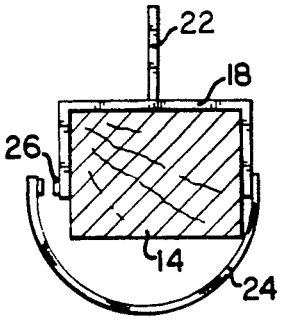
Figure 3:
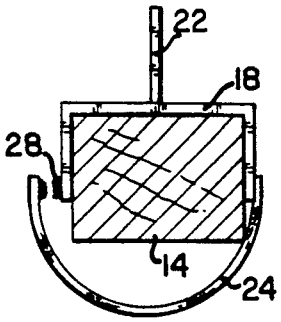
Figure 4:
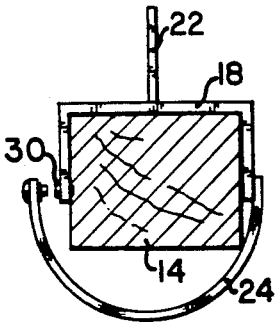

Flexible members 24 have one end permanently attached to the outside of one limb of first U-shaped body 18 and extend around arm 14. where they are temporarily attached to the outside of the second limb to secure the body in place. In FIGS. 2, 3, and 4, one end of flexible members 24 is shown permanently attached to the outer surface of one limb of first U-shaped body 18, while the opposite end has attachment means for temporarily securing that end to the outside of the opposite limb using the variety of means shown.

In FIG. 2 temporary attachment means 26 is made up of a magnet and opposed iron inset to attach the free end of flexible member 22 to the limb of first body 18 magnetically. In FIG. 3 temporary attachment means 28 is made up of opposed VELCRO surfaces with one side being the VELCRO hook side and the opposite side being the VELCRO receiver side to attach the two parts together. In FIG. 4 temporary attachment means 28 is a conventional snap connector.

Figure 5:
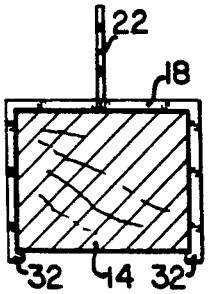

In FIG. 5 first U-shaped body 18 is formed such as to have opposed projections 32 formed such as to extend a short distance perpendicular to the inside ends of opposing limbs. Projections 32 extend inward across the lowest side of arm 14 and hold the first body in place against the arm. When projections 32 are used to secure first U-shaped body 18 to arm 14, the body must be made flexible enough to permit spreading the opposed limbs of the first body outward such that the projections can extend below the arm to attach the body to the arm.

In this first embodiment a second U-shaped body 34 is similarly attached to post 12. Second U-shaped body 34 is formed of rigid material with a U-shaped cross-section the same as U-shaped body 18 with a central spine at right angles to two opposing limbs. This spine is sized to extend partially across the outer surface of post 1 with the limbs extending partially across the side surfaces of the post. Brackets 36 are mounted on the outside of the spine of second U-shaped body 34. Brackets 36 hold third sign 38 perpendicular to the outer surface of the spine of second U-shaped body 34 by bolts extending through aligned holes in the brackets and in the third sign and secured by matching nuts.

Second U-shaped body 34 has a cap 35 which extends across the end of the spine and the limbs. Cap 35 extends partially over the top of post 12 when second U-shaped body 34 is in place against post 12 to hold it in place vertically against gravity.

Flexible members 40 also extend around post 12 to hold second U-shaped body 34 in place. Flexible members 40 are made the same as flexible members 24 which are shown in FIGS. 2, 3, and 4, having one end of the flexible members permanently secured to the outside of one limb of the second U-shaped body 34 and the opposite end having temporary attachment means to secure that end to the outside of the opposite limb.

Second U-shaped body 34 also uses an attachment means having the second U-shaped body formed the same as the body in FIG. 5, with projections 32 for securing the second U-shaped body to the post by spreading the limbs.

Figure 6:
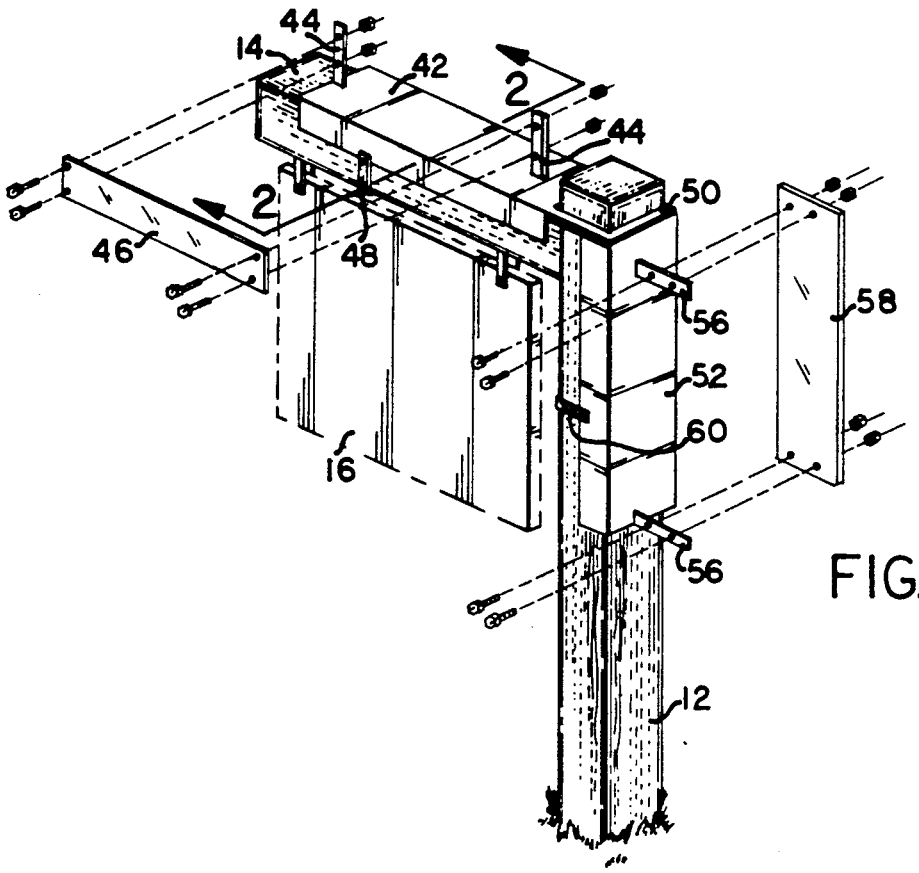
FIG. 6 is an isometric view of a post and arm showing a permanently mounted sign beneath the arm in dashed outline, and showing the second embodiments of the first and second U-shaped bodies used in supporting the first and second signs arm and post respectively.
Figure 7:
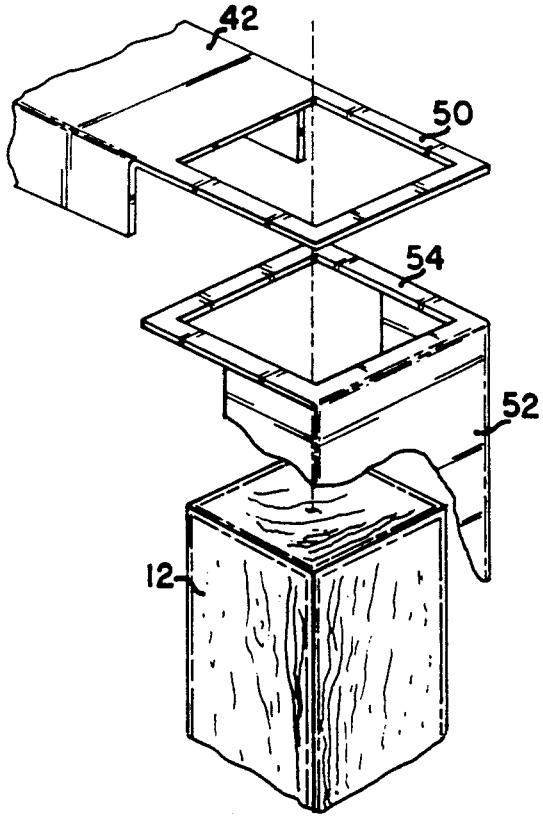
FIG. 7 is an isometric view of a detail of FIG. 6 showing the upper end of the post and the attachment of the rectangular extensions from the first and second bodies.

In the second embodiment of the invention, shown in FIGS. 6 and 7, a first U-shaped body 42 is positioned over arm 14. First U-shaped body 42 is formed of rigid material and is also shaped with a U-shaped cross-section having a spine perpendicular to two opposing limbs, with the spine sized to extend partially across the top surface and the limbs partially down the side surfaces of arm 14. Brackets 44 attached to first U-shaped body 42 hold second sign 46 perpendicular to the upper surface of the first U-shaped body by bolts extending through aligned holes in the brackets and in the second sign which are secured by matching nuts.

Flexible member 48 extends around arm 14 to hold first U-shaped body 42 in place. Flexible member 48 is made the same as flexible members 24 which are shown in FIGS. 2, 3, and 4, having one end of the flexible member permanently secured to one side of first U-shaped body 48 and the other end having attachment means for temporarily securing that end to the opposite side of the first U-shaped body.

Likewise first U-shaped body 42 uses an attachment means with the first U-shaped body formed the same as U-shaped body 18 in FIG. 5 having projections 32 to permit securing the second U-shaped body to arm 14 by spreading the limbs of the first U-shaped body.

As can be seen in FIG. 7, first U-shaped body 42 has a rectangular shaped extension 50 which is integral with the U-shaped body. Extension 50 is sized to fit over the end of post 12 to hold first U-shaped body 42 in place horizontally.

Second U-shaped body 52 is formed of rigid material and is also shaped with a U-shaped cross-section having a spine perpendicular to two opposed limbs, with the spine sized to extend partially across the outer surface of post 12, and the limbs sized to extend partially across the two surfaces of the post perpendicular to the outer surface.

Second U-shaped body 52 has an rectangular shaped extension 54 which extends over the top of post 12 perpendicular to the sides which holds the second U-shaped body in place vertically with respect to post 12 in lieu of a cap. Brackets 56 attached to second U-shaped body 52 hold third sign 58 perpendicular to the outer surface of the second U-shaped body by bolts extending through aligned holes in the brackets and in the third sign which are secured by matching nuts.

A flexible member 60 extends around arm 14 to hold the lower end of second U-shaped body 52 in place.

Flexible member 60 is made the same as flexible members 24 which are shown in FIGS. 2, 3, and 4, having one end of the flexible member permanently secured to the outside of a limb of second U-shaped body 34 and the other end having attachment means for temporarily securing that end to the opposite side of the first U-shaped body as shown.

Second U-shaped body 52 also uses an attachment means with the second U-shaped body formed the same as U-shaped body 18 in FIG. 5 with projections 32 to permit securing the second U-shaped body to post 12 by spreading the limbs of the second U-shaped body.

Both embodiments permit both a ready attachment and a ready removal of both the first sign and the second sign from the arm and post respectively, while insuring that the signs will remain securely in place unless intentionally removed. In the first embodiment the bodies are attached by positioning them against the arm or post as shown, and either securing the flexible members around the respective or spreading the limbs to secure the bodies in place. In the second embodiment the rectangular extensions are placed over the end of the post as the bodies are placed in position and then attached in the same manner as the first embodiment. Attaching the bodies is simple and quick in either embodiment and both remain securely in place unless intentionally removed. Detaching the bodies is essentially the reverse of the attachment operation and is also simple and quick.

The placement of the first and second signs with this arrangement is an improvement over the existing arrangements in that they can be seen more readily in the new locations rather than under the first sign. Further, since the first sign is supported by the arm itself and the second sign is supported by the post itself there is no danger of the supporting parts failing.

The supporting bodies can be made of sheet metal or can be extruded from plastic, either at a low cost. Plastic may be preferrable when extensions from the limbs are used to grip the arm or post rather than a flexible member because of its inherent flexibility. Metals with this characteristic are also available however, so metal can be used for this configuration also but may result in a slight increase in cost.

The flexible members can be chain, cable or any flexible member having similar characteristics. The attachment means for the flexible member can be selected from the various embodiments. This attachment arrangement for the signs will be long lasting. The resulting temporary signs are reliable and solve a very real problem in the real estate area or any other application where a temporary sign is attached to a post or an arm.

While this invention has been described with reference to illustrative embodiments, these descriptions are not intended to be construed in a limiting sense. Various modifications of the illustrative embodiments, as well as other embodiments of the invention, will be apparent to persons skilled in the art upon reference to these descriptions. It is therefore contemplated that the appended claims will cover any such modifications or embodiments as fall within the true scope of the invention.

I claim:

1. Temporary sign supporting apparatus comprising:

(a) a sheet of rigid material formed into a body with an open U-shape having a central spine and opposed planar parallel limbs of generally equal size; and (b) a sign attached perpendicularly to the spine of the body on the side which is opposite the open U-shape with the sign oriented such as to be parallel thereto, and (c) at least one flexible member of a predetermined length having one end secured to the outside of one limb and having attachment means on the opposite end for temporarily attaching the flexible member to the outside of the opposite limb, and (d) a generally planar cap extending between the limbs and to the spine across one end of the body, the cap being oriented generally perpendicular to the plane of the limbs and the center of the spine.

2. Apparatus as in claim 1 with said cap having a generally centered opening with a square shape and with two sides of the square being oriented parallel to the limbs.

3. Apparatus as in claim 1 with said U-shaped body having an outward extension from one end of that portion of the spine located between the limbs, the extension having a generally square centered opening oriented such that two of the sides are parallel with the limbs.

4. Temporary sign supporting apparatus comprising:

(a) a sheet of rigid material formed into a body with an open U-shape having a central spine and opposed planar parallel limbs of generally equal size; and (b) a sign attached perpendicularly to the spine of the body on the side which is opposite the open U-shape with the sign oriented such as to be parallel thereto, and (c) at least one flexible member of a predetermined length having one end secured to the outside of one limb and having attachment means on the opposite end for temporarily attaching the flexible member to the outside of the opposite limb, and d) the spine of said body is planar and generally perpendicular with said limbs, and e) having a generally planar cap extending between the limbs and to the spine across one end of the body, the cap being oriented generally perpendicular to the plane of the limbs and the spine.

5. Apparatus a in claim 4 with said cap having a generally centered opening with a square shape and with two sides of the square being oriented parallel to the limbs.

* * * * *